United States Patent [19]

Schaffitz et al.

[11] 4,177,948

[45] Dec. 11, 1979

[54] FUEL INJECTION NOZZLE FOR INTERNAL COMBUSTION ENGINES WITH INTERNAL MIXING

[75] Inventors: Wolfgang Schaffitz, Munich, Fed. Rep. of Germany; Eugen W. Huber, deceased, late of Munich, Fed. Rep. of Germany, by Gerda A. O. Huber-Pätzold, Anke H. L. Huber, Christina G. E. Huber, heirs

[73] Assignee: Institut für Motorenbau Professor Huber Eingetragener Verein, Munich, Fed. Rep. of Germany

[21] Appl. No.: 778,211

[22] Filed: Mar. 16, 1977

[30] Foreign Application Priority Data

Mar. 16, 1976 [DE] Fed. Rep. of Germany ..... 2610927

[51] Int. Cl.[2] ..... B05B 1/30

[52] U.S. Cl. ..... 239/533.3

[58] Field of Search ..... 239/533.3, 533.12

[56] References Cited

FOREIGN PATENT DOCUMENTS 703194 1/1971 Fed. Rep. of Germany ..... 239/533.12

79386 10/1955 Netherlands ..... 239/533.3

*Primary Examiner*—John J. Love

[57] ABSTRACT

Cavitation-induced wear-enlargement of the injection hole bores of fuel injection nozzles is prevented by providing gas passage bores which interconnect the combustion compartment and the injection hole bores at downstream locations adjacent the inlet ends of the injection hole bores.

3 Claims, 2 Drawing Figures

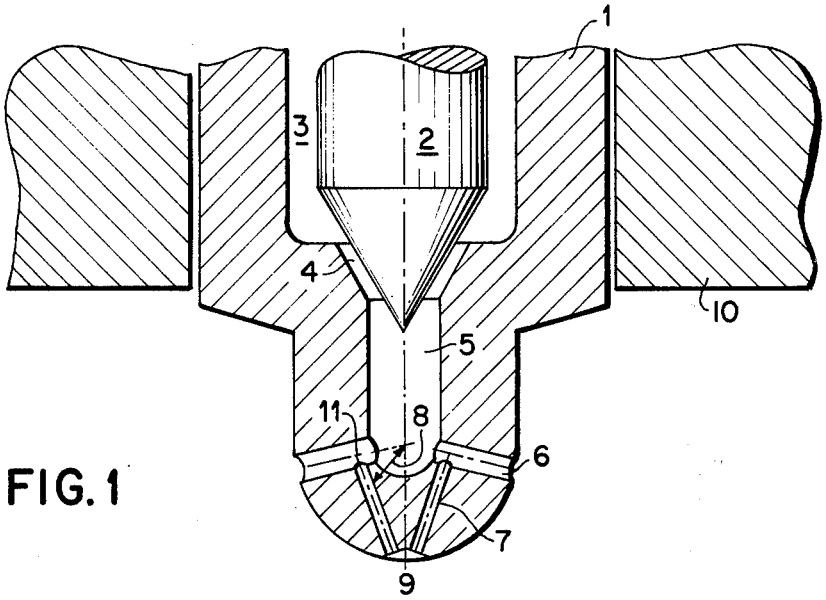
FIG. 1
FIG. 2
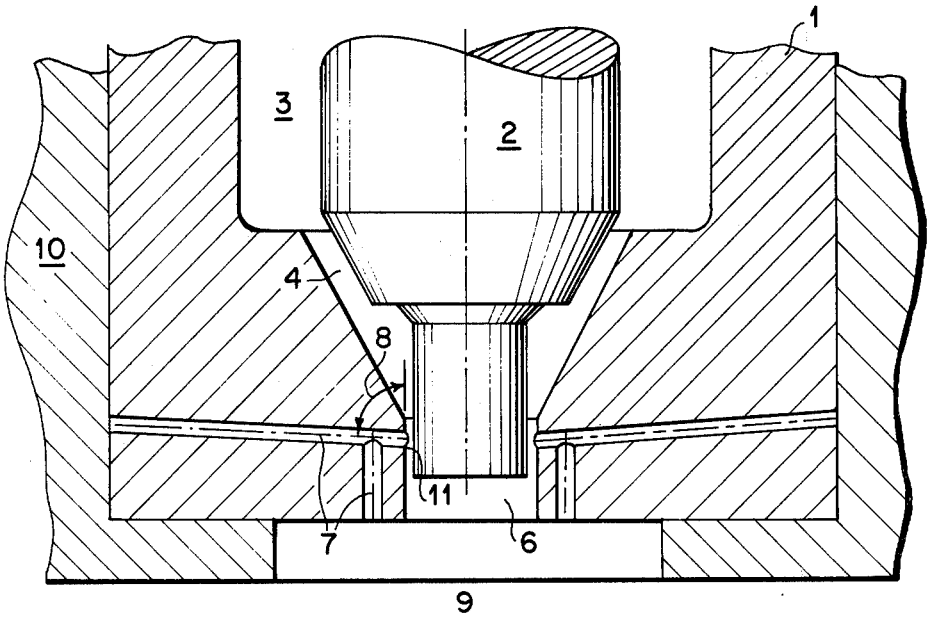

FUEL INJECTION NOZZLE FOR INTERNAL COMBUSTION ENGINES WITH INTERNAL MIXING

This invention relates to a fuel injection nozzle for internal combustion engines with internal mixing.

In known injection nozzles, a blind bore which communicates with the combustion chamber through the injection hole bores is located beneath the seat of the injector needle. During injection fuel is conveyed from the nozzle space through the open seat cross section located between said seat and said injector needle into the blind bore and is then conveyed from there through the injection hole bores into the combustion chamber under a high pressure gradient. Other fuel injection nozzles, known as pintle-type injectors, have an annular injection cross section which is located beneath the seat and which is formed by the injection hole bore and the injection pintle.

One drawback of the known fuel injection nozzles is the wear in the injection hole bore caused by cavitation of the flowing fuel.

Material is removed from the wall of the injection hole bore, thus causing it to wear downsteam of the junction with the blind bore or, in the case of the pintle-type injector, downstream of the junction with the pintle seat. The consequence is a trumpet-shaped enlargement of the injection hole bore cross section which is characteristic of this type of wear and which causes an inadmissible change in the effective nozzle cross section, in the injection pressure and in the quality of the fuel jet. This is usually accompanied by a substantial and disadvantageous disturbance or disruption in mixing the fuel and in the course of combustion in the case of internal combustion engines with internal fuel mixing.

The cause of this wear is the occurrence of cavitation in the fuel within the injection hole bore. Cavitation occurs by a sharp drop in the pressure of the fuel at the site of the smallest flow cross section immediately after entering the injection hole bore. The pressure distribution in the injection hole bore in a fuel flow which is unimpaired by cavitation shows that the fuel, which is subjected to a high hydrostatic pressure, flows out of the nozzle space through the injector needle seat into the injection hole bore, the static pressure being reduced downstream of the edge of the junction of the injection hole bore, i.e. downstream of the inlet of the injection hole bore. A constriction in the flow cross section occurs in the injection hole bore downstream of the edge of the junction, i.e. the flow cross section of the fuel narrows steadily and reaches a minimum at a specific distance in back of the edge of the junction depending on the fuel pressure and fuel density. In the case of multiple-hole nozzles, this distance equals about one injection hole bore diameter.

In this very narrow flow cross section, the hydrostatic pressure reaches a minimum value and then increases again in the direction of flow until it has again attained the pressure prevailing in the combustion chamber as it emerges out of the injection hole bore and into said combustion chamber. The narrowest effective flow cross section is defined and surrounded by a "dead fluid area" which is relatively quiet and whose border to the flowing fuel acts like a channel wall and whose contents are subjected only to a minimum static pressure. In modern internal combustion engines, the pressure differences between the blind bore or seat cross section and the combustion chamber are so high during injection that the static pressure in the narrowest cross section is reduced to such an extent that cavities develop in the fuel in the dead fluid area when the fuel vapour pressure is reached and due to localized tensile stresses. These cavities are entrained in the flow and thus reach zones of increasing pressure so that implosions are initiated there which result in cavitation wear on the injection hole bore wall.

The object of the invention is to prevent cavitation wear in the injection hole bore wall.

In an injection nozzle for internal combustion engines with internal fuel mixing, in which the fuel flows through one or more injection hole bores to the combustion chamber under a high pressure in front of said injection hole bore, and in which a constriction of the flow cross section occurs in the injection hole bore in a region in back of the edge of the junction, this object is accomplished in accordance with the invention in that one or more communicating bores or communicating channels connecting the combustion chamber and the injection hole bore are formed in the region of the constriction through which gas is conveyed from the combustion chamber into the space surrounding the constricted, flowing liquid.

The invention ensures that during their formation the cavities will be filled with gas whose pressure is relatively high so that, when the implosions begin, the gas contents of the liquid cavity will offer effective resistance to these implosions with increasing compression. The resultant gas cushion effect prevents the liquid from striking the injection hole bore wall at an extremely high impact speed during the last phase of the implosion process. This would otherwise lead to material fatigue and destruction.

For reasons of fluid mechanics, the gas pressure is always greater in the combustion chamber during fuel injection than the pressure in the space surrounding the constricted fuel flow, thereby always permitting gas to move out of the combustion chamber, through the communicating bore, and into the space surrounding the constricted, flowing fuel during injection, thereby filling liquid cavities forming at this site with gas, entraining them in the flow and supplying them to the combustion chamber so that, during any implosions which may possibly occur, the force of the liquid striking on the injection hole bore wall is prevented or dampened by the gas cushion.

In order to reliably prevent fuel from entering the combustion chamber through the communicating bore, the junction of the communicating bore into the injection hole bore is at the most perpendicular in the direction of flow so that no back-up pressure can form at the edge of the junction which, when greater than the combustion chamber pressure, will press fuel through the communicating bore into the combustion chamber.

A few embodiments of the invention are illustrated in the drawing, in which:

FIG. 1 is a multiple-hole injection nozzle according to the invention, and

FIG. 2 is a further development of a pintle-type injector nozzle according to the invention.

The nozzle cap 1 of the multiple-hole injection nozzle in accordance with FIG. 1 projects out of the cylinder head 10 into the combustion chamber 9. During injection, the injector needle 2 opens the seat 4 so that the fuel is injected out of the nozzle space 3 under high pressure through the seat 4 into the blind bore 5 and from here through the injection hole bores 6 into the combustion chamber at a high speed while experiencing a sharp loss of static pressure.

During injection, gas flows out of the combustion chamber 9 through the communicating bores 7 into the region of relative sub-pressure at the location of the flow constriction 11 in the injection hole bore 6. From here it is again entrained in the flowing fuel and enters the combustion chamber. The angle 8 between the injection hole bore and the communicating bore is smaller than 90°.

The nozzle cap 1 of the pintle-type injector in accordance with FIG. 2 does not project into the combustion chamber. During injection, the injector needle 2 opens the seat 4 so that the fuel flows out of the nozzle space 3 at a high speed and while experiencing a sharp loss of static pressure into the annular space formed by the injection hole bore 6 and the injector needle 2. From here it enters the combustion chamber 9. During injection, gas flows out of the combustion chamber 9 through the communicating bores 7 into the region of relative sub-pressure at the site of the flow constriction 11. From here it is again entrained in the flowing fuel and enters the combustion chamber. The angle 8 between the injection hole bore and the communicating bore 7 is smaller than 90°.

What is claimed is:

1. A fuel injection nozzle for internal combustion engines with internal mixing, in which the fuel flows through an injection hole bore having an inlet and an outlet end to the combustion chamber under a high pressure upstream of the inlet end of said injection hole bore, and in which a constriction of the flow cross section of the fuel occurs in the injection hole bore in a region downstream from and adjacent to the inlet end of said injection hole bore due to a reduction of static pressure in said region, the flow cross section of the injection hole bore remaining the same as the flow of fuel through said nozzle is varied, characterized in that a communicating bore connecting the combustion chamber and the injection hole bore is formed to communicate with said region of said injection hole bore to convey gas from the combustion chamber into a space of relative sub-pressure surrounding the flowing fuel in said region.

2. A fuel injection nozzle according to claim 1, wherein the included angle between the converging streams of flowing fuel in the injection hole bore and conveyed gas in the communicating bore, as defined by the axes of said bores, is less than 90°.

3. A fuel injection nozzle according to claim 1, wherein said communicating bore connects with said injection hole bore downstream of the inlet end of the latter at a distance which is approximately equal to the passageway dimension of said injection hole bore.

* * * * *